US009991611B1

(12) United States Patent
Jameson et al.

(10) Patent No.: US 9,991,611 B1
(45) Date of Patent: Jun. 5, 2018

(54) WIRE NUT (LUG) FUSE HOLDER COMBINATION

(71) Applicant: Siemens Industry, Inc., Alpharetta, GA (US)

(72) Inventors: Thomas Jameson, Bellefontaine, OH (US); Dan A. Fisher, Dublin, OH (US); Michael J. Holland, Hilliard, OH (US)

(73) Assignee: Siemens Industry, Inc., Alpharetta, GA (US)

( * ) Notice: Subject to any disclaimer, the term of this patent is extended or adjusted under 35 U.S.C. 154(b) by 0 days. days.

(21) Appl. No.: 15/702,178

(22) Filed: Sep. 12, 2017

(51) Int. Cl.

| | |
|---|---|
| ***H01R 11/01*** | (2006.01) |
| ***H01R 4/48*** | (2006.01) |
| ***H01H 85/04*** | (2006.01) |
| ***H01R 4/36*** | (2006.01) |
| ***H01H 85/20*** | (2006.01) |
| ***H01H 69/00*** | (2006.01) |

(52) U.S. Cl.
CPC ..... *H01R 4/4809* (2013.01); *H01H 69/00* (2013.01); *H01H 85/04* (2013.01); *H01H 85/202* (2013.01); *H01H 85/203* (2013.01); *H01R 4/36* (2013.01)

(58) Field of Classification Search
CPC ..... H01R 11/281; H01R 4/34
USPC ..... 439/777.801
See application file for complete search history.

(56) References Cited

U.S. PATENT DOCUMENTS

| | | | | |
|---|---|---|---|---|
| 6,971,926 | B1 * | 12/2005 | Walton | H01R 11/12 439/798 |
| 7,780,488 | B2 * | 8/2010 | Robertson | H01R 35/00 439/777 |
| 7,887,380 | B2 * | 2/2011 | Ross | H01R 11/12 29/882 |
| 8,519,267 | B2 * | 8/2013 | Peters | H01R 4/203 174/122 C |

* cited by examiner

*Primary Examiner* — Phuong Chi T Nguyen

(57) ABSTRACT

A device is provided for use with an electrical apparatus. The device comprises a wiring lug having a side and a base configured to receive a mounting screw. The wiring lug is configured to connect with a wire. The device further comprises a shaped spring configured to apply a force to a fuse for maintaining an electrical connection between the fuse and the wiring lug thus eliminating a separate electrical bus part that in a typical installation would pass a current from a conductive fuse clip to the wiring lug. The shaped spring provides a fuse clip with one side defined by the shaped spring and other side defined by the side of the wiring lug to contact a ferrule on the fuse or contact a blade extending from the ferrule on the fuse.

20 Claims, 7 Drawing Sheets

WIRE NUT (LUG) FUSE HOLDER COMBINATION

BACKGROUND

1. Field

Aspects of the present invention generally relate to a wiring lug and a fuse holder combination and more specifically relate to a device that can be used in any electrical apparatus that requires a fuse and is connected with a wire.

2. Description of the Related Art

A lug and a fuse holder combination may provide a device that can be used in any electrical apparatus that requires a fuse and is connected with a wire. However, this combination uses a connecting strap that connects the lug to fuse holder. Another design uses a lug, a bus bar and a fuse clip spring. A GE design uses a wire nut (lug) connecting strap and a fuse holder spring. The little fuse uses an aluminum extrusion plus a spring. However, existing lug and fuse holder systems for an electrical apparatus generally include a design that is not optimal.

Therefore, there is a need for effectively combining a lug and a fuse holder while overcoming various problems and shortcomings of the prior art.

SUMMARY

Briefly described, aspects of the present invention relate to combining a lug and a fuse holder in a way to eliminate a need of a connecting strap that connects the lug to the fuse holder. A wire nut (lug) can be keyed and slotted to provide accurate alignment. This embodiment eliminates a connecting strap and hardware to connect. This also eliminates elaborate extrusion with a spring.

In accordance with one illustrative embodiment of the present invention, a device is provided for use with an electrical apparatus. The device comprises a wiring lug having a side and a base configured to receive a mounting screw. The wiring lug is configured to connect with a wire. The device further comprises a shaped spring configured to apply a force to a fuse for maintaining an electrical connection between the fuse and the wiring lug thus eliminating a separate electrical bus part that in a typical installation would pass a current from a conductive fuse clip to the wiring lug. The shaped spring provides a fuse clip with one side defined by the shaped spring and other side defined by the side of the wiring lug to contact a ferrule on the fuse or contact a blade extending from the ferrule on the fuse.

In accordance with another illustrative embodiment of the present invention, a device is provided for use with an electrical safety switch. The device comprises a fuse holder including a wiring lug having a side and a shaped spring that provides a fuse clip. The wiring lug is configured to connect with a wire. The device further comprises a load base configured to receive a mounting screw to mount the wiring lug. The device further comprises a fuse with a ferrule or a fuse with a ferrule having a blade extending therefrom. The shaped spring is configured to apply a force to the fuse for maintaining an electrical connection between the fuse and the wiring lug thus eliminating a separate electrical bus part that in a typical installation would pass a current from a conductive fuse clip to the wiring lug. The shaped spring provides the fuse clip with one side defined by the shaped spring and other side defined by the side of the wiring lug to contact the ferrule on the fuse or contact the blade extending from the ferrule on the fuse.

In accordance with yet another illustrative embodiment of the present invention, a method is provided for providing a wiring lug fuse holder combination. The method comprises providing a wiring lug having a side, the wiring lug is configured to connect with a wire, providing a base configured to receive a mounting screw and providing a shaped spring configured to apply a force to a fuse for maintaining an electrical connection between the fuse and the wiring lug thus eliminating a separate electrical bus part that in a typical installation would pass a current from a conductive fuse clip to the wiring lug. The shaped spring provides a fuse clip with one side defined by the shaped spring and other side defined by the side of the wiring lug to contact a ferrule on the fuse or contact a blade extending from the ferrule on the fuse.

Still other aspects, features, and advantages of the present invention may be readily apparent from the following description by illustrating a number of example embodiments and implementations. The present invention may also be capable of other and different embodiments, and its details may be modified in various respects, all without departing from the substance and scope of the present invention. The invention covers all modifications, equivalents, and alternatives falling within the substance and scope of the invention.

DETAILED DESCRIPTION

Figure 1:
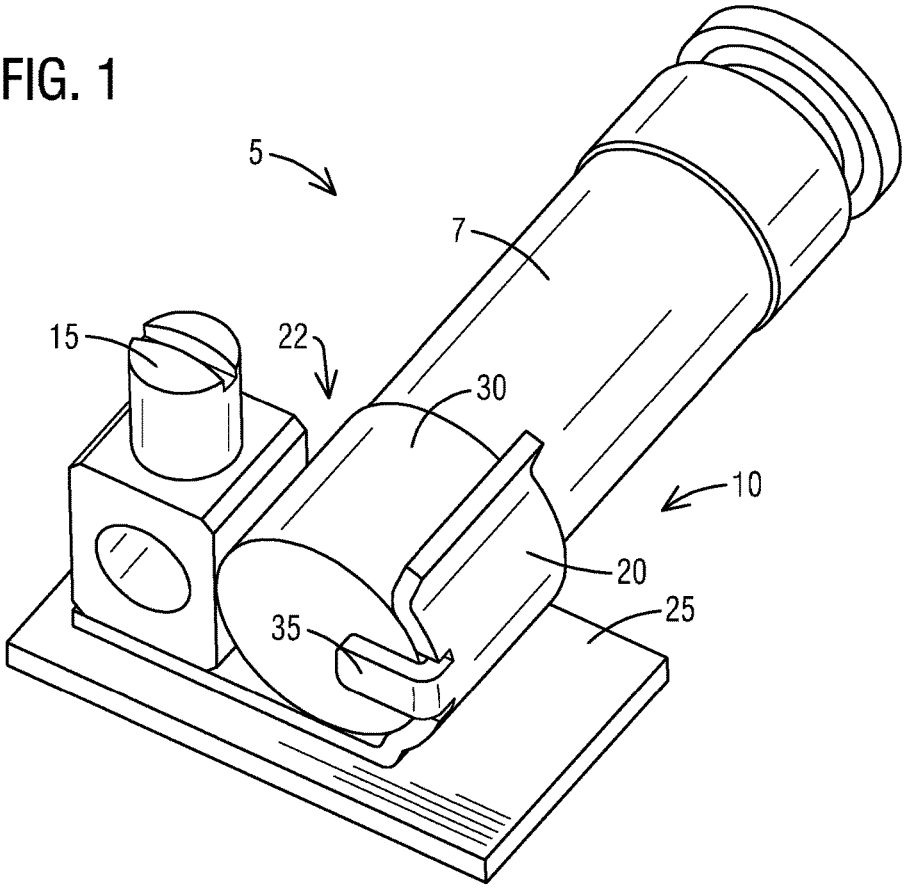
FIG. 1 illustrates a perspective view of a first wiring nut (lug) and a fuse holder combination with a fuse installed in accordance with an exemplary embodiment of the present invention.

To facilitate an understanding of embodiments, principles, and features of the present invention, they are explained hereinafter with reference to implementation in illustrative embodiments. In particular, they are described in the context of a wiring lug fuse holder combination that eliminates a need of a connecting strap that connects the lug to the fuse holder. Embodiments of the present invention, however, are not limited to use in the described devices or methods.

The components and materials described hereinafter as making up the various embodiments are intended to be illustrative and not restrictive. Many suitable components and materials that would perform the same or a similar function as the materials described herein are intended to be embraced within the scope of embodiments of the present invention.

These and other embodiments of a wiring lug fuse holder combination are described below with reference to FIGS. 1-10. The drawings are not necessarily drawn to scale. Like reference numerals are used throughout to denote like elements.

Consistent with one embodiment of the present invention, FIG. 1 represents a perspective view of a first wiring nut (lug) and a fuse holder combination 5 with a fuse 7 installed in accordance with an exemplary embodiment of the present invention. A device, i.e., the first wiring nut (lug) and a fuse holder combination 5 is for use with an electrical safety switch. The device 5 comprises a fuse holder 10 including a wiring lug 15 having a side 17 (not shown) and a shaped spring 20 that provides a fuse clip 22. The wiring lug 15 is configured to connect with a wire (not shown). The shaped spring 20 is configured to apply a force to the fuse 7 for maintaining an electrical connection between the fuse 7 and the wiring lug 15 thus eliminating a separate electrical bus part that in a typical installation would pass a current from a conductive fuse clip to the wiring lug 15.

The device 5 further comprises a base 25 such as a load base configured to receive a mounting screw (not seen) to mount the wiring lug 15. The shaped spring 20 comprises spring steel and the base 25 comprises plastic and the wiring lug 15 comprises aluminum or copper.

The fuse 7 with a ferrule 30 may be installed in the device 5. The shaped spring 20 provides the fuse clip 22 with one side defined by the shaped spring 20 and other side defined by the side of the wiring lug 15 to contact the ferrule 30 on the fuse 7. The fuse clip 22 provides a fuse stop 35. The fuse clip 22 incorporates a rejection feature for class R fusing.

Figure 2:
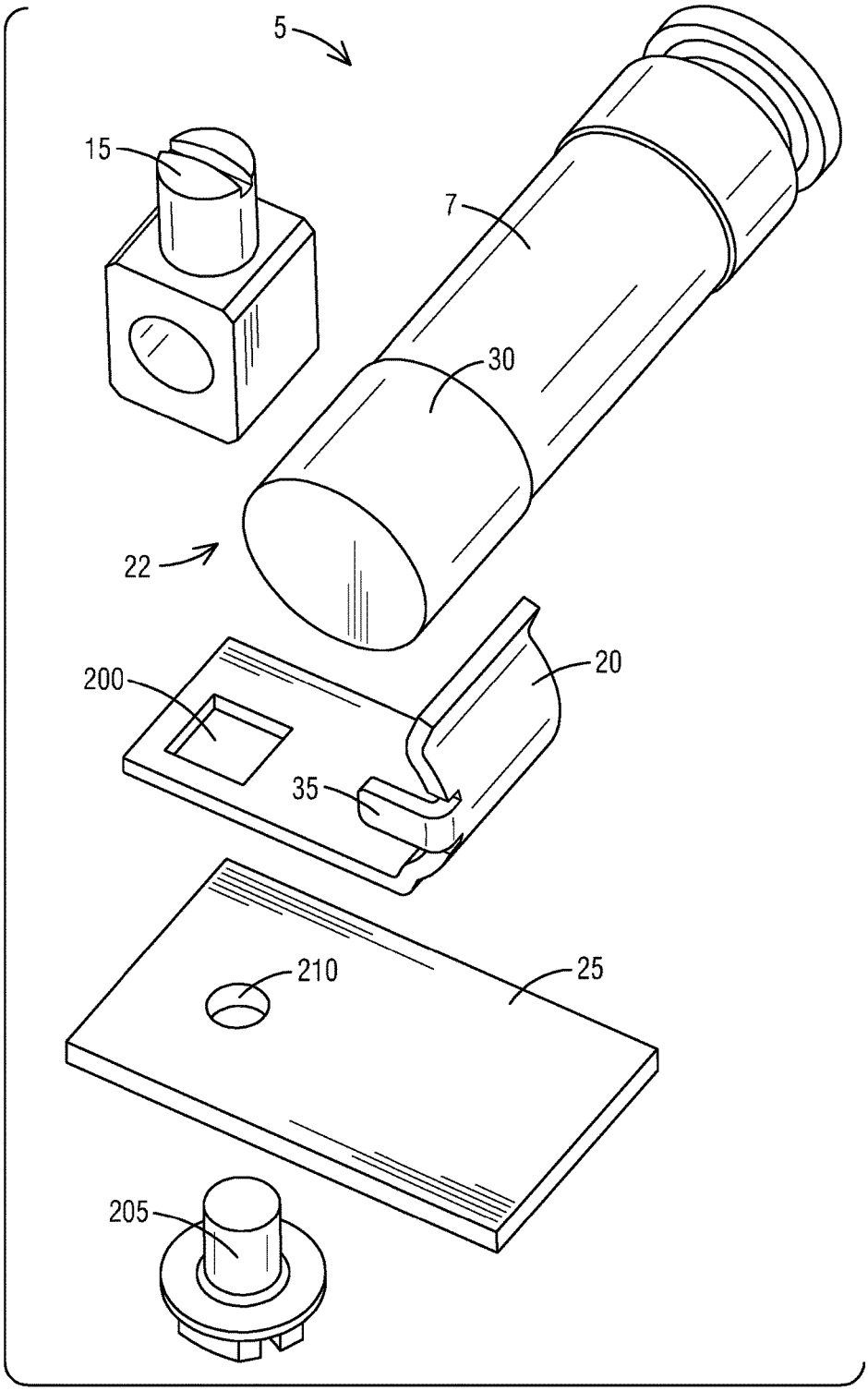
FIG. 2 illustrates an exploded view of the first wiring nut (lug) and the fuse holder combination of FIG. 1 in accordance with an exemplary embodiment of the present invention.

Referring to FIG. 2, it illustrates an exploded view of the first wiring nut (lug) and the fuse holder combination 5 of FIG. 1 in accordance with an exemplary embodiment of the present invention. The fuse clip 22 includes a hole 200 that is shaped to match a mating feature (not seen) in the wiring lug 15 to provide for an alignment of the fuse clip 22 and the wiring lug 15. The device, i.e., the first wiring nut (lug) and a fuse holder combination 5 further comprises a mounting screw 205 to secure the wiring lug 15 to the base 25. The hole 200 in the fuse clip 22 allows the mounting screw 205 to pass through the base 25 into the wiring lug 15. The base 25 includes a hole 210 to receive the mounting screw 205.

Figure 3:
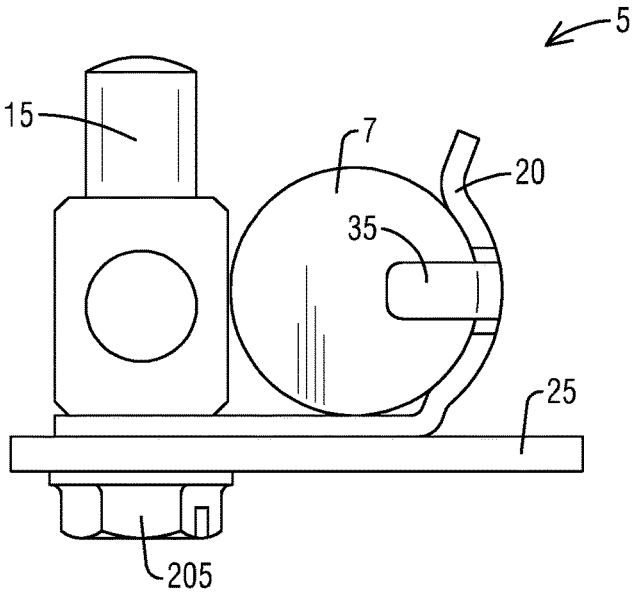
FIG. 3 illustrates a front view of the first wiring nut (lug) and the fuse holder combination of FIG. 1 in accordance with an exemplary embodiment of the present invention.

Turning now to FIG. 3, it illustrates a front view of the first wiring nut (lug) and the fuse holder combination 5 of FIG. 1 in accordance with an exemplary embodiment of the present invention. The wiring lug 15 is keyed and slotted to provide a desired alignment. The device, i.e., the first wiring nut (lug) and the fuse holder combination 5 eliminates a connecting strap and hardware to connect. The device, i.e., the first wiring nut (lug) and the fuse holder combination 5 also eliminates elaborate extrusion with a spring.

The device, i.e., the first wiring nut (lug) and the fuse holder combination 5 can be used in any electrical apparatus that requires a fuse and is connected with a wire. In this design, the side of the wiring lug 15 is used as part of the fuse clip 22. The shaped spring 20 applies force to the fuse 7 maintaining an electrical connection between the fuse 7 and the wiring lug 15. This eliminates a separate electrical bus part that in a typical installation would pass the current from a conductive fuse clip to the wiring lug 15.

Figure 4:
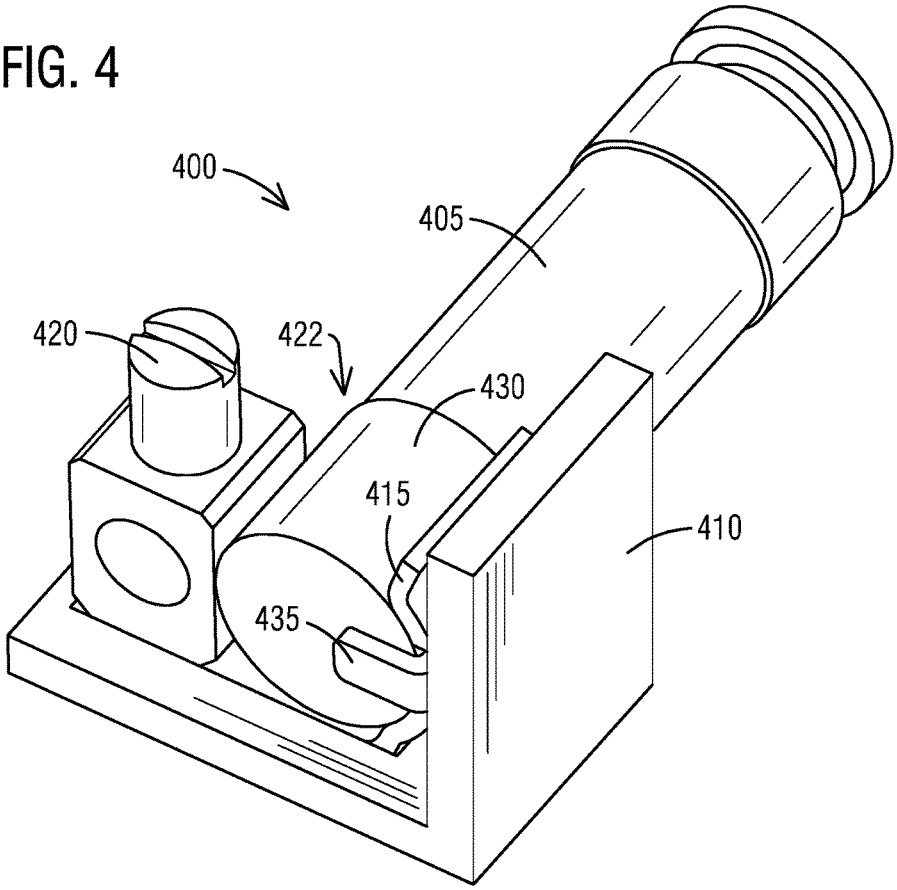
FIG. 4 illustrates a perspective view of a second wiring nut (lug) and a fuse holder combination with a fuse installed such that a base provides an additional alignment and a stop for a spring in accordance with an exemplary embodiment of the present invention.

FIG. 4 illustrates a perspective view of a second wiring nut (lug) and a fuse holder combination 400 with a fuse 405 installed such that a base 410 provides an additional alignment and a stop for a shaped spring 415 in accordance with an exemplary embodiment of the present invention. A device, i.e., the second wiring nut (lug) and the fuse holder combination 400 is configured for use with any electrical apparatus that requires the fuse 405 and is connected with a wire.

The device, i.e., the second wiring nut (lug) and the fuse holder combination 400 comprises a wiring lug 420 having a side. The wiring lug 420 is configured to connect with a wire. The device, i.e., the second wiring nut (lug) and the fuse holder combination 400 further comprises the base 410 that is configured to receive a mounting screw (not seen). The device, i.e., the second wiring nut (lug) and the fuse holder combination 400 further comprises the shaped spring 415 configured to apply a force to the fuse 405 for maintaining an electrical connection between the fuse 405 and the wiring lug 420 thus eliminating a separate electrical bus part that in a typical installation would pass a current from a conductive fuse clip to the wiring lug 420. The shaped spring 415 provides a fuse clip 422 with one side defined by the shaped spring 415 and other side defined by the side of the wiring lug 420 to contact a ferrule 430 on the fuse 405. The fuse clip 422 provides a fuse stop 435.

Figure 5:
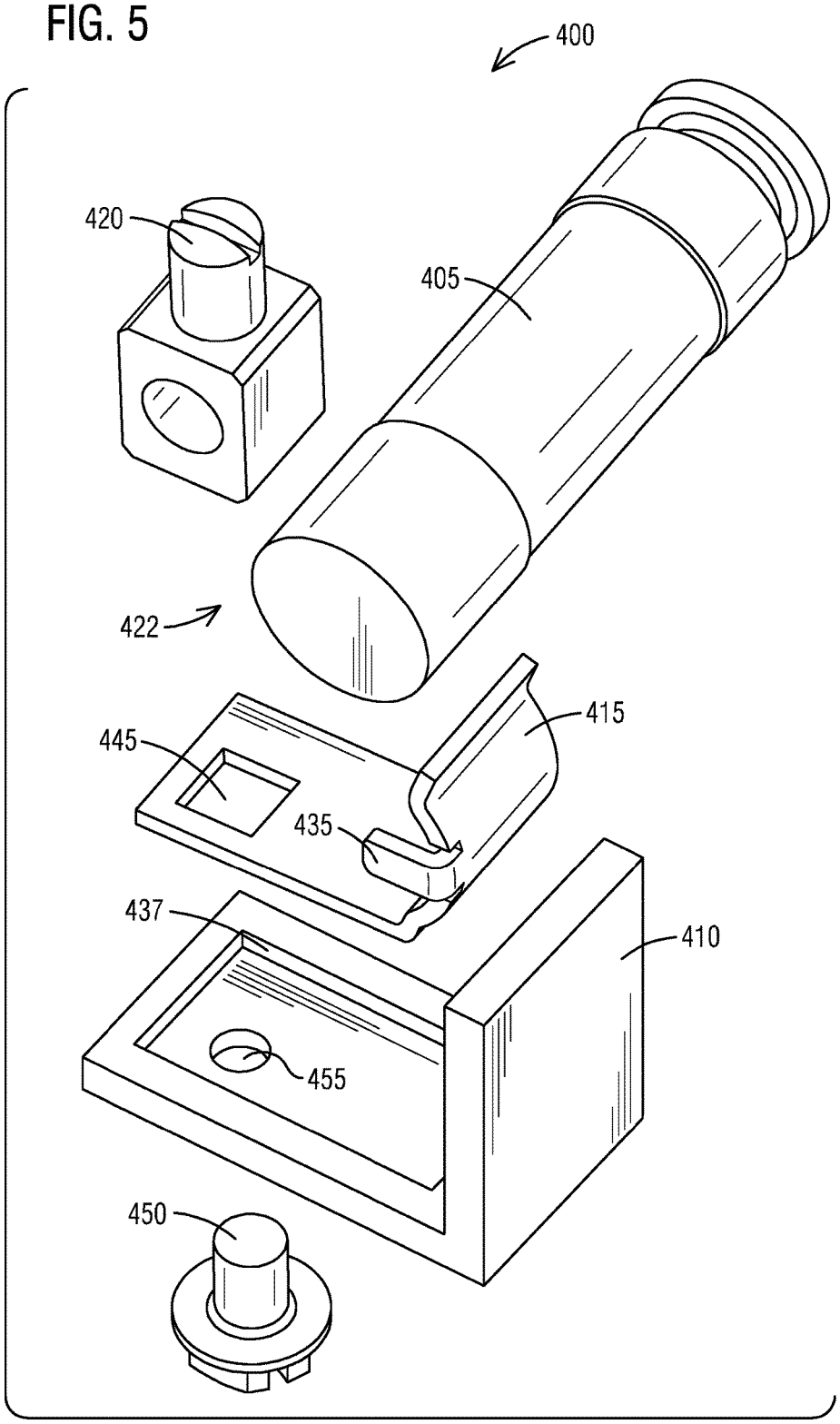
FIG. 5 illustrates an exploded view of the second wiring nut (lug) and the fuse holder combination of FIG. 4 in accordance with an exemplary embodiment of the present invention.

As seen in FIG. 5, it illustrates an exploded view of the second wiring nut (lug) and the fuse holder combination 400 of FIG. 4 in accordance with an exemplary embodiment of the present invention. The base 410 includes an additional alignment feature 437 to provide a stop for the shaped spring 415. The base 410 includes a wall 440 that is positioned in a way to keep the shaped spring 415 from being opened beyond its working distance.

The fuse clip 422 includes a hole 445 that is shaped to match a mating feature (not seen) in the wiring lug 420 to provide for an alignment of the fuse clip 422 and the wiring lug 420. The hole 445 in the fuse clip 422 allows a mounting screw 450 to pass through the base 410 into the wiring lug 420. The fuse clip 422 provides the fuse stop 435. The fuse clip 422 also incorporates a typical rejection feature for class R fusing. The base 410 includes a hole 455 to receive the mounting screw 450.

Figure 6:
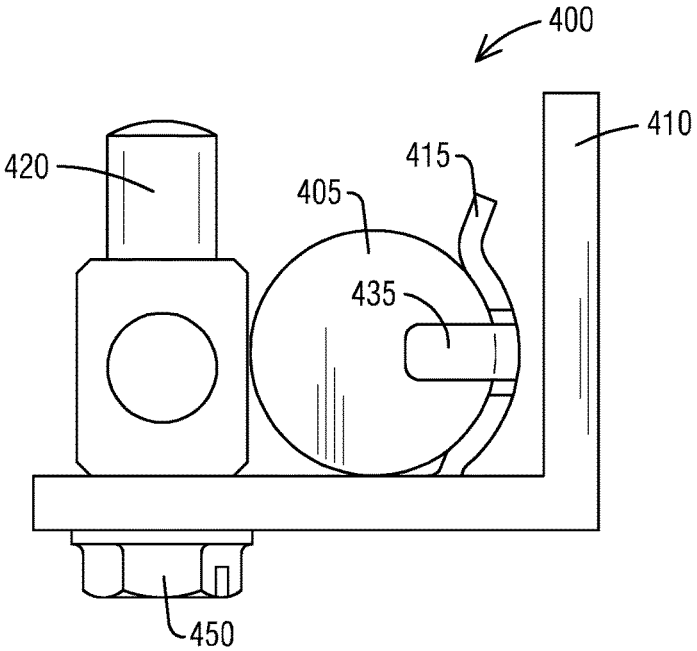
FIG. 6 illustrates a front view of the second wiring nut (lug) and the fuse holder combination of FIG. 4 in accordance with an exemplary embodiment of the present invention.

As shown in FIG. 6, it illustrates a front view of the second wiring nut (lug) and the fuse holder combination 400 of FIG. 4 in accordance with an exemplary embodiment of the present invention. The wiring lug 420 is keyed and slotted to provide a desired alignment. The device, i.e., the second wiring nut (lug) and the fuse holder combination 400 eliminates a connecting strap and hardware to connect. The device, i.e., the second wiring nut (lug) and the fuse holder combination 400 also eliminates elaborate extrusion with a spring.

The device, i.e., the second wiring nut (lug) and the fuse holder combination 400 can be used in any electrical apparatus that requires a fuse and is connected with a wire. In this design, the side of the wiring lug 420 is used as part of the fuse clip 422. The shaped spring 415 applies force to the fuse 405 maintaining an electrical connection between the fuse 405 and the wiring lug 420. This eliminates a separate electrical bus part that in a typical installation would pass the current from a conductive fuse clip to the wiring lug 420.

Figure 7:
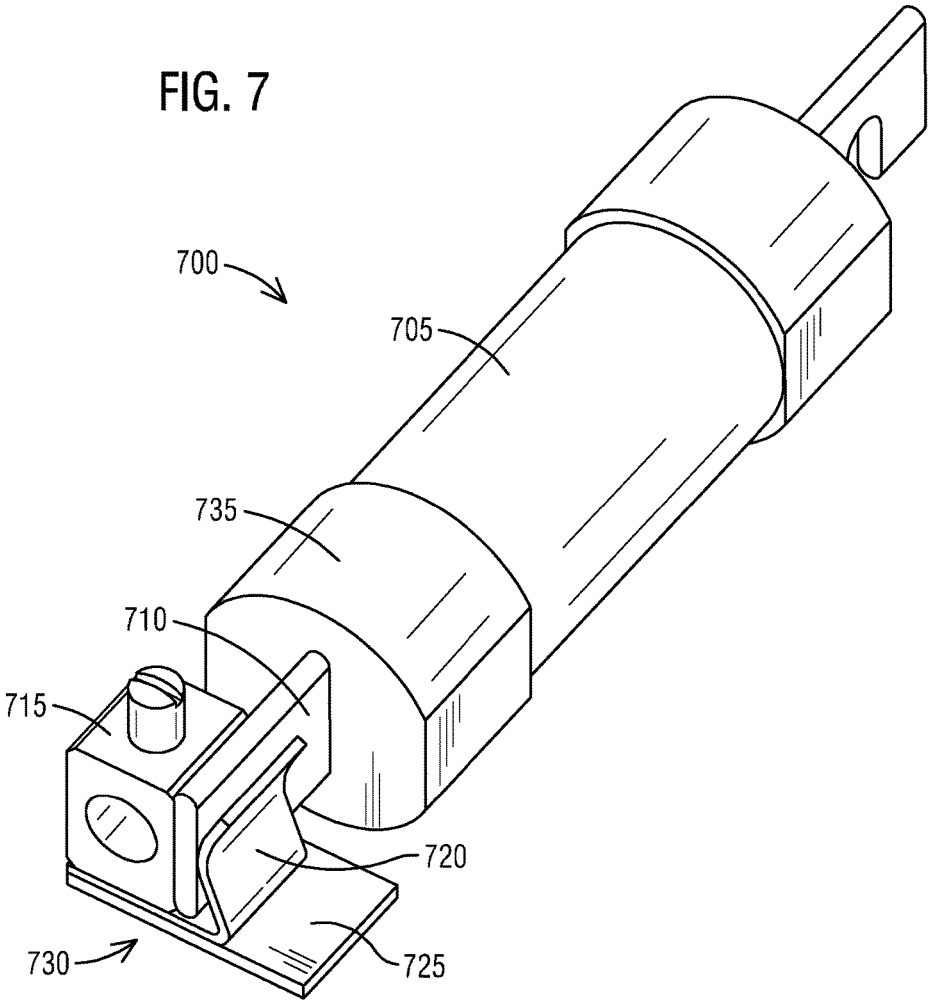
FIG. 7 illustrates a perspective view of a third wiring nut (lug) and a fuse holder combination with a fuse installed such that a blade of the fuse contacts the wiring nut (lug) and a spring in accordance with an exemplary embodiment of the present invention.

In FIG. 7, it illustrates a perspective view of a third wiring nut (lug) and a fuse holder combination 700 with a fuse 705 installed such that a blade 710 of the fuse 705 contacts a wiring lug 715 and a shaped spring 720 in accordance with an exemplary embodiment of the present invention. A device, i.e., the third wiring nut (lug) and the fuse holder combination 700 is configured for use with any electrical apparatus that requires the fuse 705 and is connected with a wire.

The device, i.e., the third wiring nut (lug) and the fuse holder combination 700 comprises the wiring lug 715 having a side. The wiring lug 715 is configured to connect with a wire. The device, i.e., the third wiring nut (lug) and the fuse holder combination 700 further comprises a base 725 that is configured to receive a mounting screw (not seen). The device, i.e., the third wiring nut (lug) and the fuse holder combination 700 further comprises the shaped spring 720 configured to apply a force to the fuse 705 for maintaining an electrical connection between the fuse 705 and the wiring lug 715 thus eliminating a separate electrical bus part that in a typical installation would pass a current from a conductive fuse clip to the wiring lug 715. The shaped spring 720 provides a fuse clip 730 with one side defined by the shaped spring 720 and other side defined by the side of the wiring lug 715 to contact the blade 710 extending from a ferrule 735 on the fuse 705.

Figure 8:
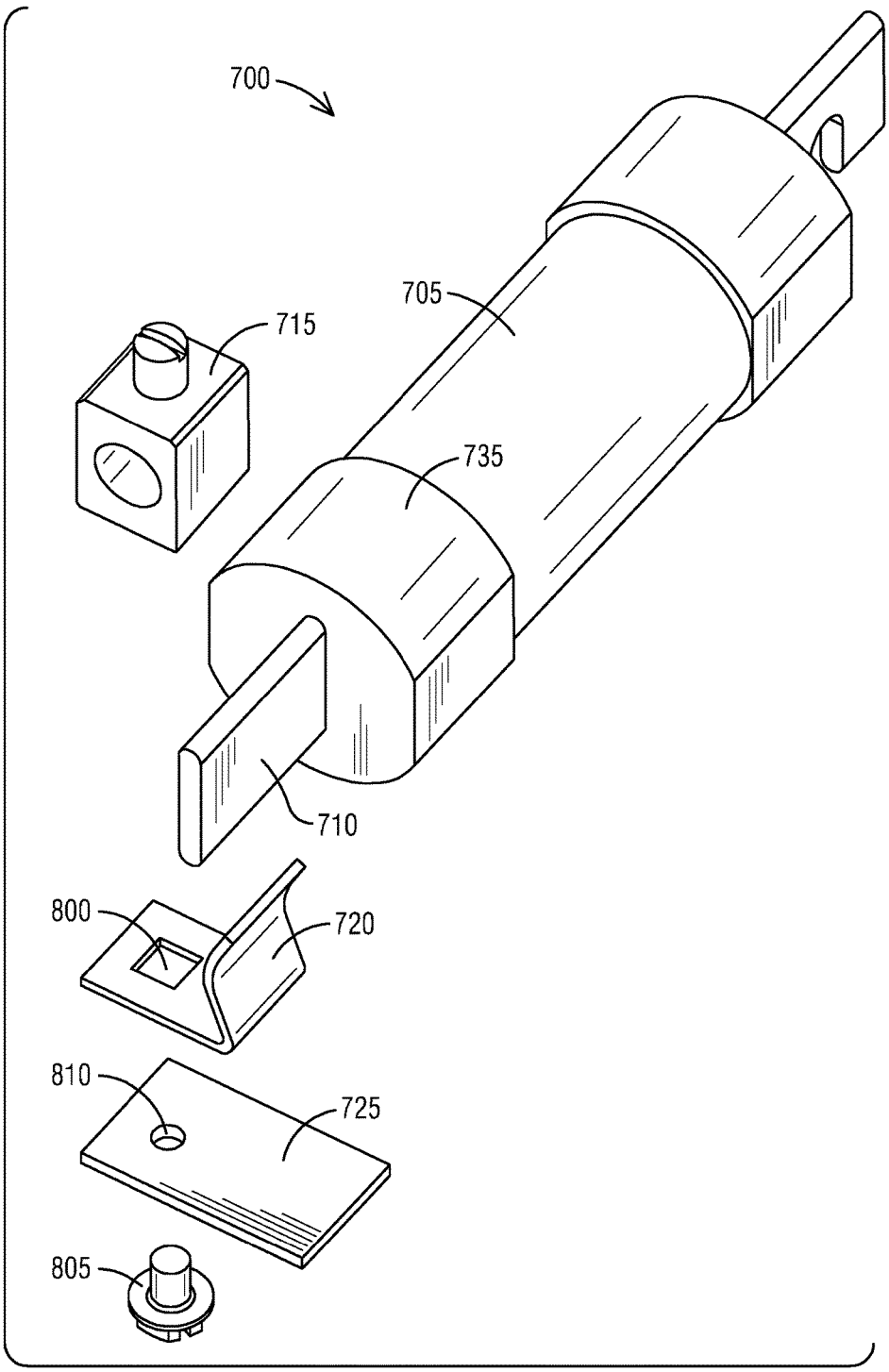
FIG. 8 illustrates an exploded view of the third wiring nut (lug) and the fuse holder combination of FIG. 7 in accordance with an exemplary embodiment of the present invention.

FIG. 8 illustrates an exploded view of the third wiring nut (lug) and the fuse holder combination 700 of FIG. 7 in accordance with an exemplary embodiment of the present invention. The fuse clip 730 (not shown in FIG. 8) includes a hole 800 that is shaped to match a mating feature (not seen) in the wiring lug 715 to provide for an alignment of the fuse clip 730 and the wiring lug 715. The hole 800 in the fuse clip 730 allows a mounting screw 805 to pass through the base 725 into the wiring lug 715. The base 725 includes a hole 810 to receive the mounting screw 805.

Figure 9:
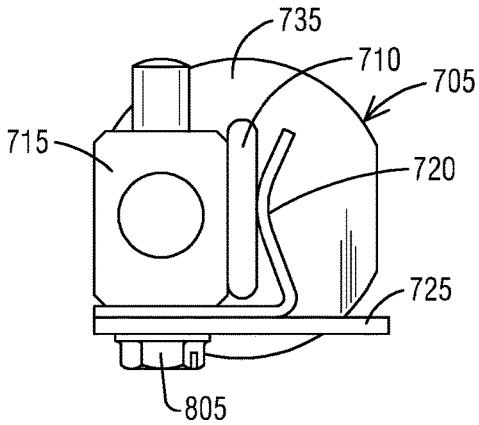
FIG. 9 illustrates a front view of the third wiring nut (lug) and the fuse holder combination of FIG. 7 in accordance with an exemplary embodiment of the present invention.

FIG. 9 illustrates a front view of the third wiring nut (lug) and the fuse holder combination 700 of FIG. 7 in accordance with an exemplary embodiment of the present invention. The wiring lug 715 is keyed and slotted to provide a desired alignment. The device, i.e., the third wiring nut (lug) and the fuse holder combination 700 eliminates a connecting strap and hardware to connect. The device, i.e., the third wiring nut (lug) and the fuse holder combination 700 also eliminates elaborate extrusion with a spring. The device, i.e., the third wiring nut (lug) and the fuse holder combination 700 can be used in any electrical apparatus that requires a fuse and is connected with a wire.

Figure 10:
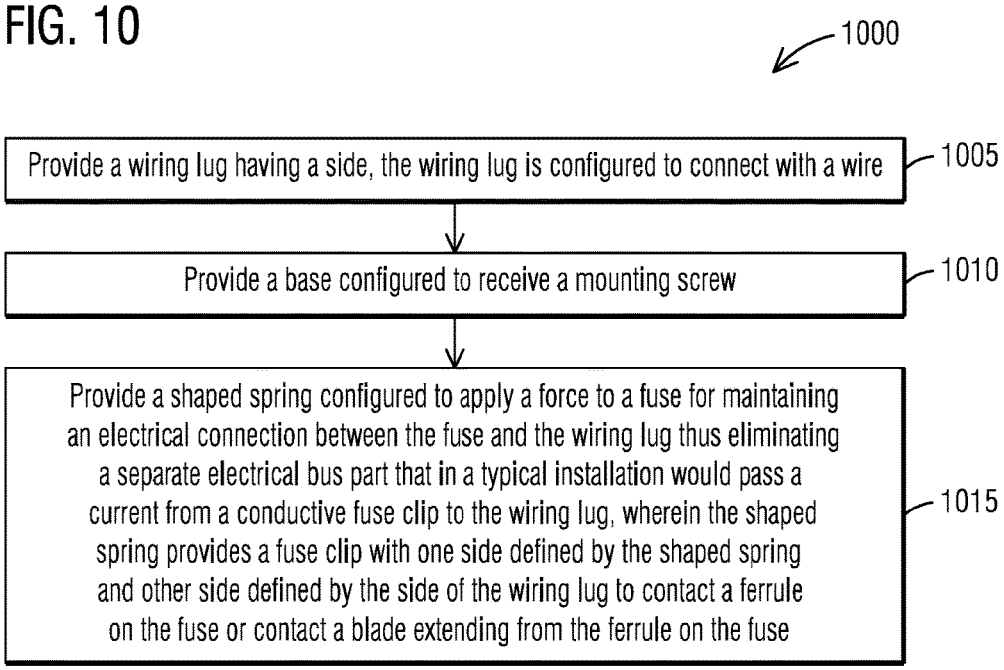
FIG. 10 illustrates a flowchart of a method for providing a wiring lug fuse holder combination according to an exemplary embodiment of the present invention.

FIG. 10 illustrates a flowchart of a method 1000 for providing a wiring lug fuse holder combination according to an exemplary embodiment of the present invention. Reference is made to the elements and features described in FIGS. 1-9. It should be appreciated that some steps are not required to be performed in any particular order, and that some steps are optional.

The method 1000 for providing the wiring lug fuse holder combination at step 1005 includes providing a wiring lug having a side, the wiring lug is configured to connect with a wire. The method 1000 further comprises providing a base configured to receive a mounting screw at step 1010. The method 1000 further comprises providing a shaped spring configured to apply a force to a fuse for maintaining an electrical connection between the fuse and the wiring lug thus eliminating a separate electrical bus part that in a typical installation would pass a current from a conductive fuse clip to the wiring lug at step 1015. The shaped spring provides a fuse clip with one side defined by the shaped spring and other side defined by the side of the wiring lug to contact a ferrule on the fuse or contact a blade extending from the ferrule on the fuse.

As used herein, "wiring lug fuse holder combination" refers to a lug and a fuse holder combination that may provide a device that can be used in any electrical apparatus that requires a fuse and is connected with a wire such that this combination does not use a connecting strap to connect the lug to the fuse holder. A fuse clip is provided with one side defined by a shaped spring and other side defined by the side of a wiring lug. The "fuse clip," in addition to the exemplary hardware description above, refers to a conductive L-shaped structure that is able to hold a fuse in place.

The techniques described herein can be particularly useful for cylindrical-shaped fuse. While particular embodiments are described in terms of the cylindrical-shaped fuse, the techniques described herein are not limited to the cylindrical-shaped fuse but can also use other shapes of fuses.

While embodiments of the present invention have been disclosed in exemplary forms, it will be apparent to those skilled in the art that many modifications, additions, and deletions can be made therein without departing from the spirit and scope of the invention and its equivalents, as set forth in the following claims.

Embodiments and the various features and advantageous details thereof are explained more fully with reference to the non-limiting embodiments that are illustrated in the accompanying drawings and detailed in the following description. Descriptions of well-known starting materials, processing techniques, components and equipment are omitted so as not to unnecessarily obscure embodiments in detail. It should be understood, however, that the detailed description and the specific examples, while indicating preferred embodiments, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, article, or apparatus that comprises a list of elements is not necessarily limited to only those elements but may include other elements not expressly listed or inherent to such process, article, or apparatus.

Additionally, any examples or illustrations given herein are not to be regarded in any way as restrictions on, limits to, or express definitions of, any term or terms with which they are utilized. Instead, these examples or illustrations are to be regarded as being described with respect to one particular embodiment and as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms.

In the foregoing specification, the invention has been described with reference to specific embodiments. However, one of ordinary skill in the art appreciates that various modifications and changes can be made without departing from the scope of the invention. Accordingly, the specification and figures are to be regarded in an illustrative rather than a restrictive sense, and all such modifications are intended to be included within the scope of invention.

Although the invention has been described with respect to specific embodiments thereof, these embodiments are merely illustrative, and not restrictive of the invention. The description herein of illustrated embodiments of the invention is not intended to be exhaustive or to limit the invention to the precise forms disclosed herein (and in particular, the inclusion of any particular embodiment, feature or function is not intended to limit the scope of the invention to such embodiment, feature or function). Rather, the description is intended to describe illustrative embodiments, features and functions in order to provide a person of ordinary skill in the art context to understand the invention without limiting the invention to any particularly described embodiment, feature or function. While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Respective appearances of the phrases "in one embodiment," "in an embodiment," or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

It will also be appreciated that one or more of the elements depicted in the drawings/figures can also be implemented in a more separated or integrated manner, or even removed or rendered as inoperable in certain cases, as is useful in accordance with a particular application.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

What is claimed is:

1. A device for use with an electrical apparatus, the device comprising:

a wiring lug having a side, the wiring lug is configured to connect with a wire;

a base configured to receive a mounting screw; and a shaped spring configured to apply a force to a fuse for maintaining an electrical connection between the fuse and the wiring lug thus eliminating a separate electrical bus part that in a typical installation would pass a current from a conductive fuse clip to the wiring lug, wherein the shaped spring provides a fuse clip with one side defined by the shaped spring and other side defined by the side of the wiring lug to contact a ferrule on the fuse or contact a blade extending from the ferrule on the fuse.

2. The device of claim 1, wherein the fuse clip provides a fuse stop.

3. The device of claim 1, wherein the fuse clip incorporates a rejection feature for class R fusing.

4. The device of claim 1, wherein the shaped spring comprises spring steel and the base comprises plastic and the wiring lug comprises aluminum or copper.

5. The device of claim 1, wherein the base includes an additional alignment feature to align the fuse clip to the wiring lug.

6. The device of claim 1, wherein the base includes a wall that is positioned in a way to keep the shaped spring from being opened beyond its working distance.

7. The device of claim 1, wherein the wiring lug is keyed and slotted to provide a desired alignment.

8. The device of claim 1, wherein the fuse clip includes a hole that is shaped to match a mating feature in the wiring lug to provide for an alignment of the fuse clip and the wiring lug.

9. The device of claim 8, wherein the hole in the fuse clip allows the mounting screw to pass through the base into the wiring lug.

10. A device for use with an electrical safety switch, the device comprising:

a fuse holder including a wiring lug having a side and a shaped spring that provides a fuse clip, wherein the wiring lug is configured to connect with a wire;

a load base configured to receive a mounting screw to mount the wiring lug; and a fuse with a ferrule or a fuse with a ferrule having a blade extending therefrom, wherein the shaped spring is configured to apply a force to the fuse for maintaining an electrical connection between the fuse and the wiring lug thus eliminating a separate electrical bus part that in a typical installation would pass a current from a conductive fuse clip to the wiring lug, and wherein the shaped spring provides the fuse clip with one side defined by the shaped spring and other side defined by the side of the wiring lug to contact the ferrule on the fuse or contact the blade extending from the ferrule on the fuse.

11. The device of claim 10, wherein the fuse clip provides a fuse stop.

12. The device of claim 10, wherein the fuse clip incorporates a rejection feature for class R fusing.

13. The device of claim 10, wherein the fuse clip includes a hole that is shaped to match a mating feature in the wiring lug to provide for an alignment of the fuse clip and the wiring lug.

14. The device of claim 13, wherein the hole in the fuse clip allows the mounting screw to pass through the base into the wiring lug.

15. A method for providing a wiring lug fuse holder combination, the method comprising:

providing a wiring lug having a side, the wiring lug is configured to connect with a wire;

providing a base configured to receive a mounting screw; and providing a shaped spring configured to apply a force to a fuse for maintaining an electrical connection between the fuse and the wiring lug thus eliminating a separate electrical bus part that in a typical installation would pass a current from a conductive fuse clip to the wiring lug, wherein the shaped spring provides a fuse clip with one side defined by the shaped spring and other side defined by the side of the wiring lug to contact a ferrule on the fuse or contact a blade extending from the ferrule on the fuse.

16. The method of claim 15, wherein the fuse clip provides a fuse stop.

17. The method of claim 15, wherein the fuse clip incorporates a rejection feature for class R fusing.

18. The method of claim 15, wherein the shaped spring comprises spring steel and the base comprises plastic and the wiring lug comprises aluminum or copper.

19. The method of claim 15, wherein the fuse clip includes a hole that is shaped to match a mating feature in the wiring lug to provide for an alignment of the fuse clip and the wiring lug.

20. The method of claim 19, wherein the hole in the fuse clip allows the mounting screw to pass through the base into the wiring lug.

* * * * *